United States Patent [19]

Stahlecker

[11] Patent Number: 4,514,975

[45] Date of Patent: May 7, 1985

[54] FRICTION ROLLER ARRANGEMENT FOR OPEN END FRICTION SPINNING MACHINE

[75] Inventor: Fritz Stahlecker, Josef-Neidhart-Strasse 18, 7347 Bad Ueberkingen, Fed. Rep. of Germany

[73] Assignees: Hans Stahlecker; Fritz Stahlecker, of DEX

[21] Appl. No.: 573,725

[22] Filed: Jan. 25, 1984

[30] Foreign Application Priority Data

Feb. 23, 1983 [DE] Fed. Rep. of Germany ..... 3306225

[51] Int. Cl.[3] ..... D01H 1/135; D01H 1/20

[52] U.S. Cl. ..... 57/401; 57/104

[58] Field of Search ..... 57/400, 401, 92, 104, 57/105

[56] References Cited

U.S. PATENT DOCUMENTS

| | | | |
|---|---|---|---|
| 4,334,400 | 6/1982 | Fehrer | 57/401 X |
| 4,380,892 | 4/1983 | Parker et al. | 57/401 |
| 4,399,650 | 8/1983 | Parker et al. | 57/401 |

*Primary Examiner*—Donald Watkins

*Attorney, Agent, or Firm*—Barnes & Thornburg

[57] ABSTRACT

Two adjacently arranged friction rollers are disposed to form a yarn forming wedge slot. Cover shells for the rollers are respectively directly carried by roller bearings at an axle. The axles are formed as hollow axles through which a suction flow in the region of the wedge slot is created. The drive for the rollers results by means of a direct tangential belt drive on the surface of the shells in the region of one of the roller bearings.

26 Claims, 9 Drawing Figures

27
26'
68
65
16
16'
14
II
18
12
II
20
24
25
5
21
1
6
4
8
2,3
V
28
10,11
66
III
III
60,61
22
19
23
15
13
7
17'
IV
IV
9
17
31
30

FRICTION ROLLER ARRANGEMENT FOR OPEN END FRICTION SPINNING MACHINE

BACKGROUND AND SUMMARY OF THE INVENTION

The invention relates to apparatus for open end friction spinning of the type which includes two adjacently arranged friction rollers driven in the same direction and forming a yarn forming wedge slot, which rollers respectively exhibit a shell, which in the region of both of its ends is carried by roller bearings.

In an apparatus for open end friction spinning of the above mentioned general kind (DE-OS No. 31 41 733), it is known to use roller bearings to carry the shell of the rollers in the region of both of the ends. In this manner, the accuracy of the disposition of the two shells with respect to one another is improved as compared to a flying arrangement. In the known construction, in which the shells are formed as hyperboloids, the ends of the shells are provided with sliding type intermediate pieces which are formed as receptacles for the outer ring of the roller bearing. As to the kind of drive for the rollers, there is nothing described.

The invention is based upon the problem to so form the drive and the bearing for rollers in an apparatus of the above-mentioned kind, that while maintaining a high accuracy, a simple design and also a simple drive is facilitated.

The problem is thereby solved in that the shells are arranged immediately on the roller bearing and that a belt drive is used for the drive with at least one belt provided running directly on the surface of the shells.

With the arrangement of the invention, because the roller bearings directly receive the shells, the tolerances for the rotating shells and also for the adjustment of the wedge slot can be maintained very small. Through the direct drive of the belt engaging at the coating surface of the shells, it is avoided that one needs a special driving shaft or the like, further leading to a simplification. Because the circumferential velocity of the shells is relatively small, the belt speed is also relatively small. Because the belt furthermore runs at a larger diameter it can function with relatively smaller belt tension so that also a relatively smaller belt can be installed.

In practical embodiments of the invention it is provided that the shells exhibit a cylindrical pipe formed shape. Thereby it is possible to form all of the roller bearings with the same dimensions, something that is especially cost effective for series production and for the holding of the bearing in use.

In practical embodiments of the invention it is provided that the shells are carried by axles which protrude beyond both of the end faces of the shell and which are carried at a common bearing housing. Through the common bearing housing it is possible to adjust the axles of the shells, and therewith also the shells, exactly with respect to one another without causing difficulties during the assembly.

In a first embodiment of the invention it is provided that the axles are clamped in shell shaped receptacles of the bearing housing. The shell shaped receptacles in the bearing housing can be prepared in a common manufacturing procedure so that the desired manufacturing accuracies are achieved with simple means.

In another embodiment of the invention, a bearing housing is provided which essentially extends over the axial length of the shells and includes a cover type holder arranged with receptacles for the axles at the end face portions of the shells. It is especially advantageous if the receptacles of the holder are adjustable in distance from one another in the direction of the common plane of the axles. Thereby it is possible to adjust during the assembly, and in any event also later, the size of the desired wedge slot.

In further developments of the inveniton it is provided that the axle of at least one of the rollers, whose shell in the region between the roller bearings is perforated, is constructed hollow and is connecte at a suction connection, and that the axle exhibits a slot formed opening facing the wedge slot. Through this arrangement it is achieved that one or also both rollers can be formed as so called suction rollers whereby also here the manufacturing expenditure is small. It is especially simple if the apparatus is formed with hollow axles made out of a continuous pipe with the same diameter.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
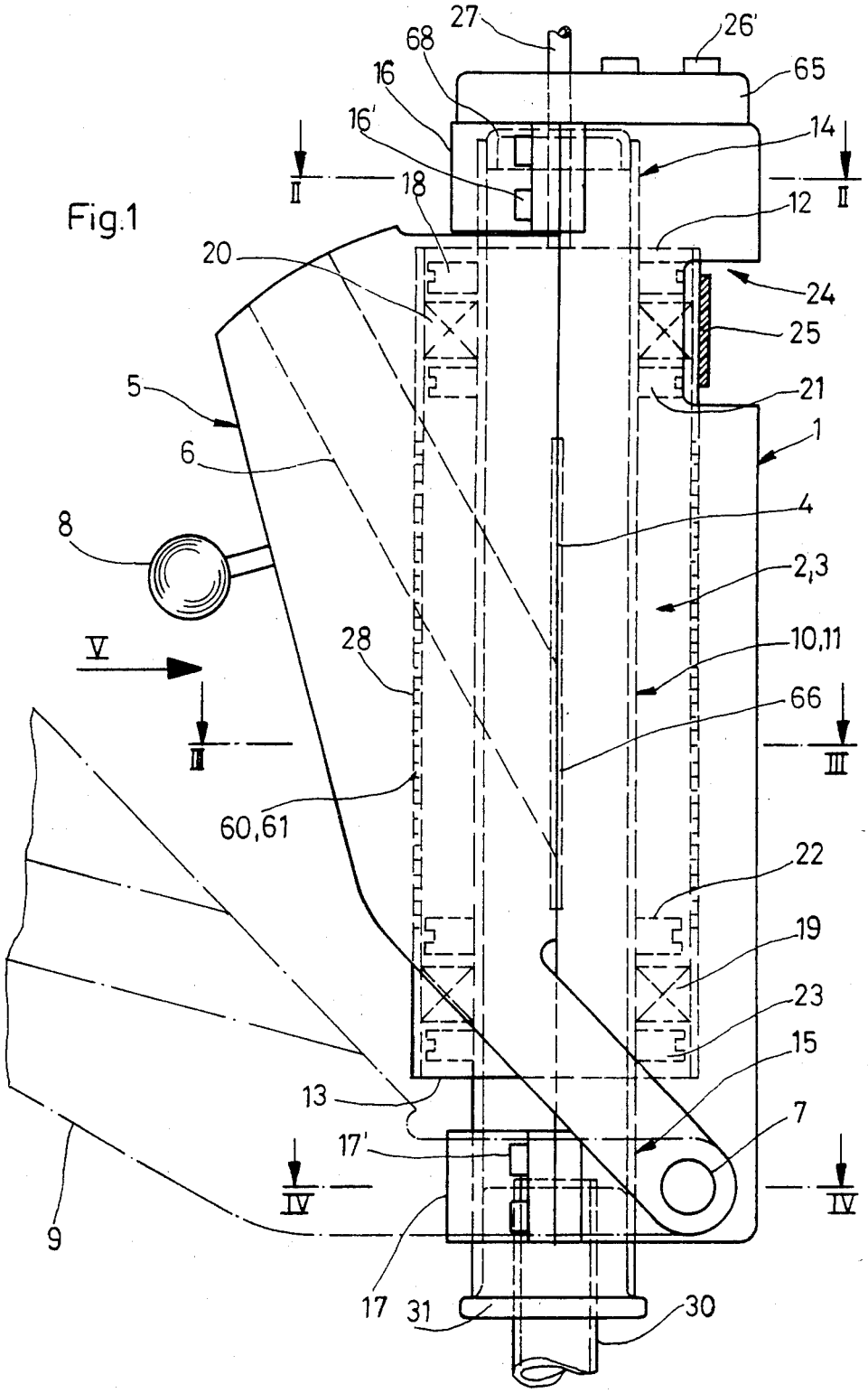
FIG. 1 is a partial side view of an apparatus for open end friction spinning, in the region of the bearing and the drive engagement for two friction rollers forming a yarn producing wedge slot, constructed in accordance with a preferred embodiment of the invention.

The apparatus illustrated only partly in FIG. 1 includes two vertically extending closely adjacent and parallely arranged friction rollers 2 and 3 which together form a wedge slot 4 therebetween. A fiber inlet channel guides single fibers of opened fiber material to this wedge slot 4, where the same are turned into a yarn with the help of the rollers 2 and 3 rotating in the same rotational direction, which yarn is drawn off in the axial direction of the slot 4 toward the top via a yarn withdrawal tube 27. The supply of feeding of the single fibers of opened fiber material is by way of a not illustrated feeding and opening device of the type which is known from open end rotor spinning devices. For withdrawing the yarn, a not further illustrated withdrawal roller pair is provided, followed by likewise unillustrated winding apparatus which winds the yarn at a spool.

In all illustrated embodiments, both of the rollers 2 and 3 are respectively identically constructed, with the same dimensions and configured as so called suction rollers. It should be explained that this is not a necessary provision because both rollers can be provided with different dimensions in both the axial length and in their diameter and both of the rollers 2 and 3 need not be formed as suction rollers In the embodiment of FIGS. 1 to 5, the rollers 2 and 3 possess a pipe shaped cylindricl shell 60 and 61, which are rotatably borne in the region of their respective ends 12 and 13 by roller bearings 19 and 20. The roller bearings 19 and 20 each include a bearing outer ring and a bearing inner ring between which roller bodies are arrranged in a manner known per se, which roller bodies advantageously are formed as balls and guided in cages. The bearing outer rings of the roller bearing 19, and 20 are installed with a light press fit into the respective shells 60 and 61. The bearing inner rings of the roller bearings 19 and 20 are seated at respective tubular pieces 10, 11 serving as axles. The bearing inner rings can also be installed with a light press fit at the tubular pieces 10, 11. Additionally, it is contemplated to provide a ring band as an abutment stop for the axial securement.

The respective ends of both pipe or tubular pieces 10 and 11 extend beyond the upper ends 12 and the lower ends 13 of the shells 60 and 61 and are there supported at a common bearing housing 1.

The bearing housing 1 is provided with half shell shaped openings 14 and 15 in which the pipe pieces 10 and 11 are clamped with the help of likewise half shell shaped receptacle clamp covers 16 and 17, which by means of screws 16' and 17' are screw connected on corresponding flanges of the bearing housing 1. The upper clamping cover 16 is provided with a bore through which the yarn withdrawal tube 27 is guided in the direction of an extension of the wedge slot 4. The yarn withdrawal tube 27 is held at the bearing housing 1 by means of cover 65 fastened by means of screws 26'. It is also contemplated in other embodiments to avoid the auxiliary cover 65 and connect the yarn withdrawal tube 27 directly at the clamping cover 16.

Figure 3:
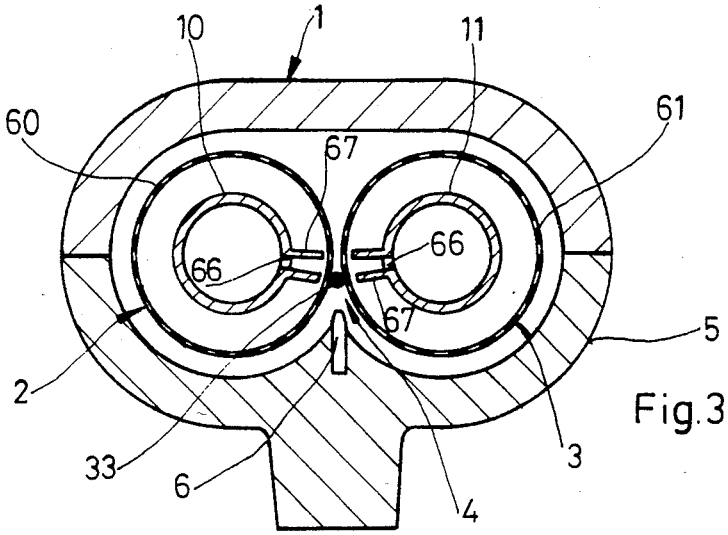
FIG. 3 is a sectional view taken along line III—III of FIG. 1.
Figure 4:
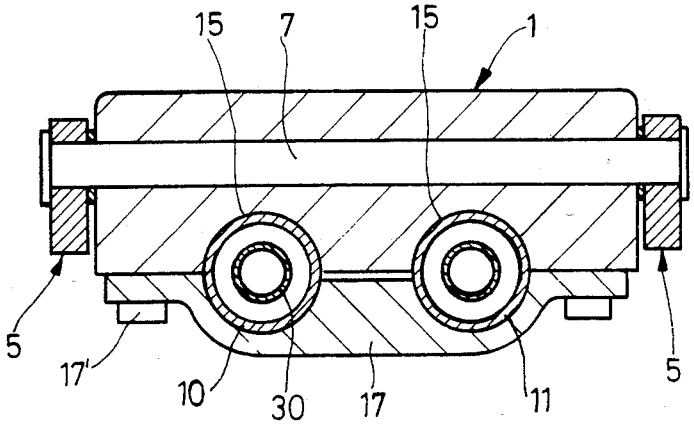
FIG. 4 is a sectional view taken along line IV—IV of FIG. 1.

As especially can be seen from FIGS. 1 and 3 the fiber feed channel 6 is arranged in an intermediate housing 5 that is pivotally carried to be movable between the dash-dot line non-operating position and the solid line operating position shown in the FIG. 1 illustration. The intermediate housing 5, which is shown with a servicing handle 8, grips with fork like arms laterally of the bearing housing 1 and is pivotally borne thereat by means of a pivot axle 7 in the regions of the lower ends 13. In the illustrated embodiments the intermediate housing 5 possesses half shell shaped openings with which it surrounds the shells 60, 61 at least in the region between the two roller bearings 19 and 20 in which the creation or manufacture of the yarn 33 (FIG. 3) results. The intermediate housing 5 supports itself with its vertical edges at the corresponding vertically extending edges of the bearing housing 1, when in the operating position. The bearing housing 1 extends along the shells 60 and 61 likewise at least in the region between the rollers bearings 19 and 20 in a shell shaped manner so that this region is completely surrounded. On the other hand it is also contemplated to limit the intermediate housing to the region in which the fiber inlet channel 6 is diposed so that the shells 60 and 61 are exposed in the remaining regions.

The pipe pieces 10 and 11, serving as axles for the rollers 2 and 3, carry sealing rings 18, 21, 22, and 23 adjacent the roller bearings 19 and 20 for preventing the loss of grease or lubricating oil and/or the penetration of contaminants. This is especially practical if, as in the illustrated embodiment, both rollers 2 and 3 are formed as suction rollers. For this purpose the shells 60 and 61 are perforated with holes or bores 28 in the region between the bearings 19 and 20. In the pipe pieces 10 and 11 an under pressure is created which leads to an inward suction air stream in the region of the wedge slot 4 in the shells 60 and 61. The upper ends 12 of the pipe pieces 10 and 11 are closed with inserted stoppers 68. In the lower ends 13 of the pipe pieces 10 and 11, the stopper 31 is inserted, which is provided with a suction connection 30, connected in turn to a lower pressure source. In the region where they are oppositely disposed one another at the fiber forming wedge slot 4, the pipe pieces 10 and 11 are provided with slits 66 at which esssentially radially extending protrusion 67 connect. Protusions 67 protrude to a position closely adjacent the inner surfaces of the respective shells 60 and 61 so that the suction draft is limited to a predeterined region of the shells 60 and 61 (FIG. 3).

Figure 5:
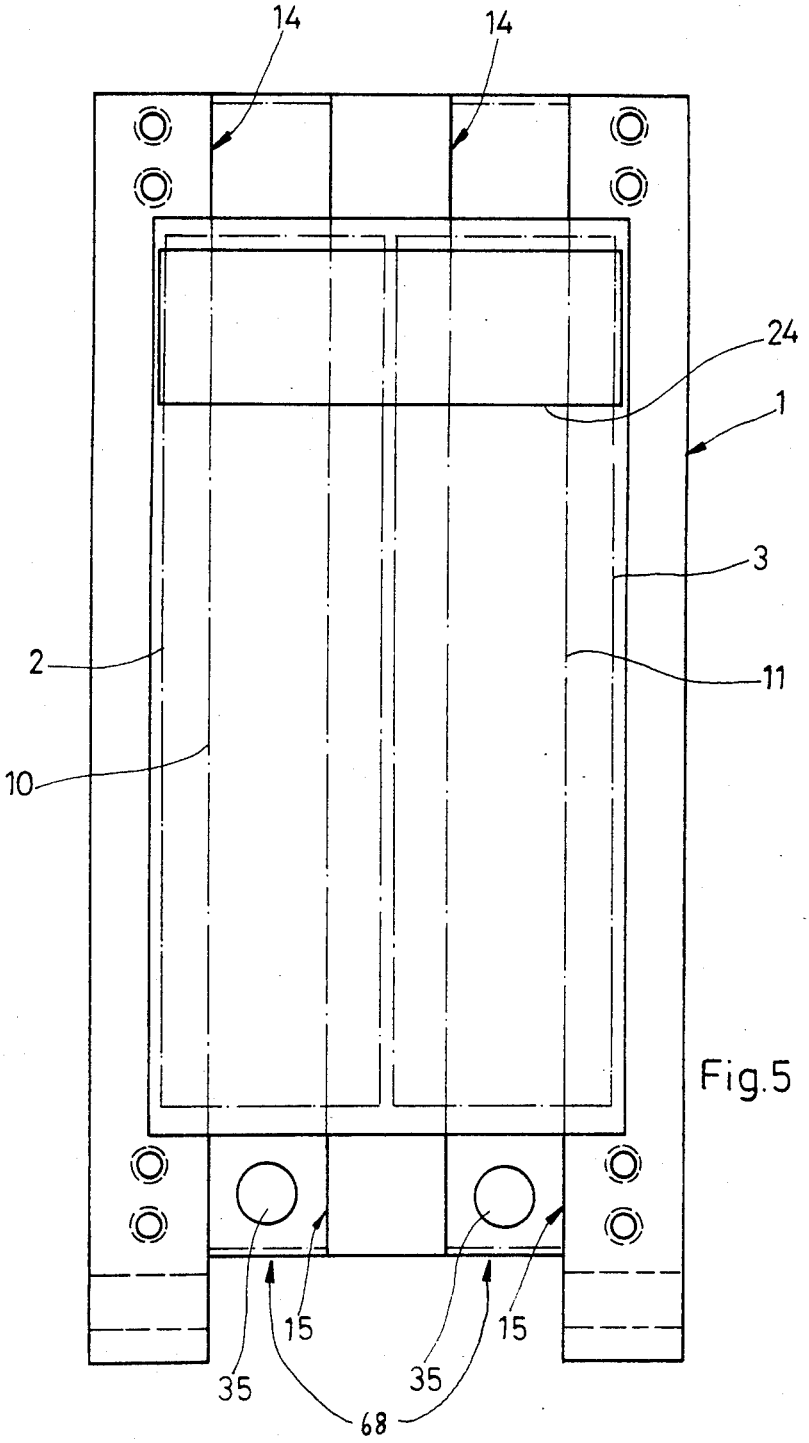
FIG. 5 is a view in the direction of the arrow V of the common bearing housing used in FIG. 1, whereby further parts are only illustrated in dashed lines.

As shown in FIG. 5, in a modification of the embodiment of FIG. 1, the lower end of the pipe piece 10 and 11 can be closed with a stopper 68. A suction connection 35 is then respectively provided in the region of the openings 15, which is connected by means of cross bores with the pipe pieces 10 and 11.

The drive for both rollers 2 and 3 results by means of a tangential belt 25 which engages on the outer surface of shells 60 and 61 in the region of the roller bearing 20. The tangential belt 25 grips at the shells 60 and 61 at the side region opposite the inlet channel 6, for which purpose the bearing housing 1 is provided with a corresponding horizontally extending opening 24.

In order to assemble an open end friction spinning machine with the apparatus according to FIGS. 1 to 5, the there illustrated devices are arranged adjacent one another in a row so that the tangential belt 25 then drives all of the rollers 2 and 3 of the devices of a machine side.

Figure 2:
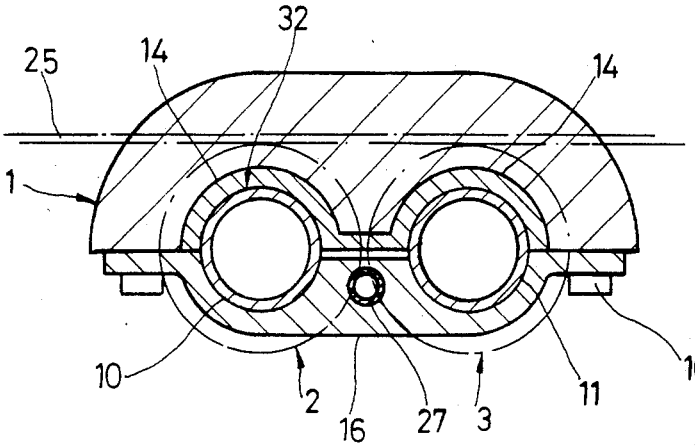
FIG. 2 is a sectional view taken along the line II—II of FIG. 1.

The common bearing housing 1 for both rollers 2 and 3 as well as the pipe pieces 10 and 11 has the advantage thet the openings 14 and 15 can be formed in a common manufacturing procedure so that an alignment of both rollers 2 and 3 with respect to one another is assured with a high exactitude. In order to dampen the existence of running noise, it is furthermore practical to coat the openings 14 and 15 with a coating 32 made of a noise dampening elastic material, that is shown in the FIG. 2 illustration in exaggerated thickness.

Figure 6:
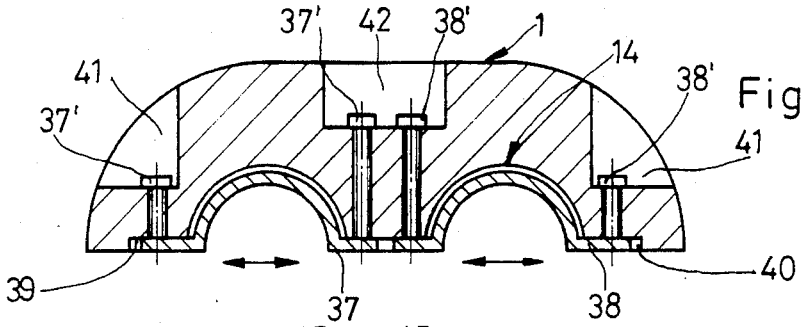
FIG. 6 is a sectional view similar to FIG. 2 through a bearing housing with adjustable shell formed openings for the reception of axles of the rollers, constructed in accordance with another preferred embodiment of the invention.

In order to facilitate the possibility to adjust the rollers 2 and 3 relative to one another and thereby to change the position and/or size of the wedge slot 4, it is provided in correspondence to the embodiment of FIG. 6 that shell shaped inserts 37 and 38 are inserted in the shell shaped openings 14 of the bearing housing 1 (likewise in the shell shaped opening 15), which in turn receive the axles of the rollers 2 and 3. These shell shaped inserts 37 and 38 can be slideable into crank shaped guides 39 and 40 of the bearing housing 1. Inserts 37, 38 are held by means of their heads at cut outs 41 and 42 of the bearing housing 1 by inserted screws 37' and 38' which are guided in oblong bores of the bearing housing 1.

Figure 7:
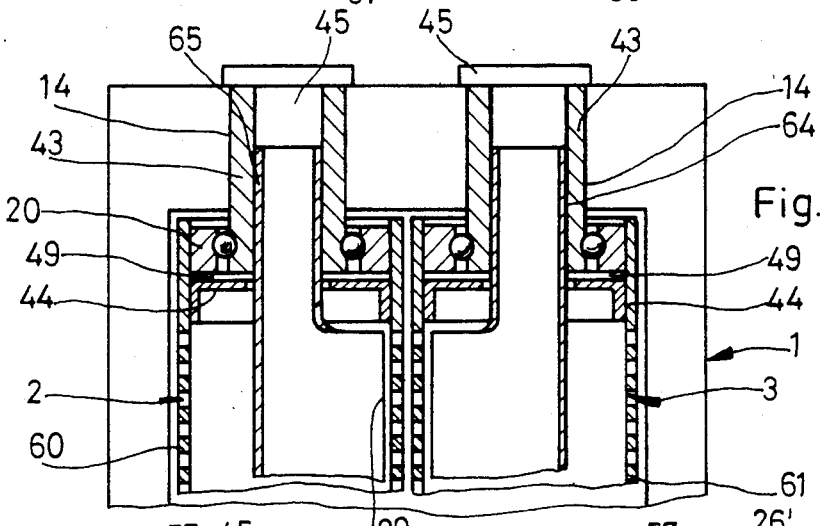
FIG. 7 is a part sectional view through a further embodiment of the invention taken along a section surface in the common plane of the axles of the rollers.

In the embodiment of FIG. 7, the axles on which the shells 60 and 61 are carried by means of the roller bearings 19 and 20, are formed as a multipartite. The roller bearings 19 and 20, of which only the roller bearing 20 is illustrated, possess a bearing inner ring 43 which is extended toward the outside over the end of the shells 60 and 61 and which is held in the shell shaped openings 14 of the bearing housing 1. In the bearing inner ring there are installed or inserted, inner insertions 64 of suction inserts 29 which are opened to the perforated shell 60, 61 in the region of the wedge slot 4. The connection at a vacuum or under pressure source is similar to the connection in FIGS. 1 to 5, this means via a suction connection inserted in the bearing inner ring 43 or by means of a transversely extending suction connection which is guided through the bearing housing 1. Corresponding to the example of FIG. 7, the outer disposed ends of the bearing inner ring 43 are closed by means of stoppers 45.

According to the embodiments of FIG. 7, the respective roller bearings 19 and 20 are provided with angular shaped sealing rings 44 which are pressed into the shells 60 and 61. These angular sealing rings 44 form an axial sealing slot 49 with respect to the bearing inner ring 43 and an auxiliary radial sealing slot with respect to the cylindrical protrusion 64 of the suction insert 29.

Figure 8:
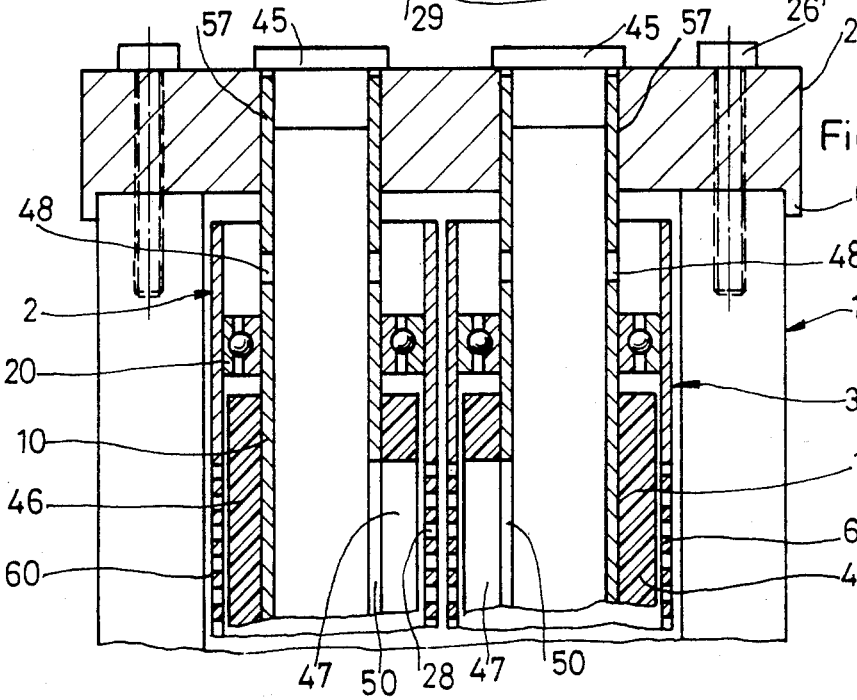
FIG. 8 is a part sectional view similar to FIG. 7 through a further embodiment of the invention.

According to the embodiment of FIG. 8, the bearing housing 1 extends essentially only over the axial length of the shells 60 and 61. The pipe pieces 10 and 11 serving as axles are in this embodiment held in receptacle 57 of holder 26 which is connected by means of the screws 26' at the facing side of the bearing housing 1. The holder 26 is centered on the bearing housing 1, for example by means of protrusion 67 gripping over bearing housing 1 or also by means of dowel pins. The lower ends 13 of the pipe pieces 10 and 11 serving as axles can be held in corresponding holders 26 at the bearing housing 1. It is however also contemplated to provide at one side, the FIG. 1 arrangement, a shell shaped opening 15 and clamping cover 17 in connection with the holder 26.

According to the embodiment of FIG. 8, the pipe pieces 10 and 11 are formed with a constant smooth diameter in the region between the roller bearings 19 and 20. They exhibit axial slits 50 in the region of the sides facing the wedge slot 4. On the outside of the pipe pieces 10 and 11 in the region between the roller bearings 19 and 20, filling pieces 46 are disposed which approximately fill the entire inner space between the pipe pieces 10 and 11 and the shell 60 and 61 with a small play for the shells 60 and 61. These filling pieces 46, which advantageously can be manufactured out of synthetic material, (plastic) possess corresponding axial slits 47 in the region of the slits 50 of the pipe pieces 10 and 11, through which the suction air stream is aligned at a predetermined region of the shells 60 and 61. The slits 50 of the pipe pieces 10 and 11 exhibit a circumferential breadth which is wider than the slits 47 in the filing pieces 46 so that through a rotation of the filling piece 46 with respect to the pipe pieces 10 and 11, a supplemental adjustment of the direction of the suction air stream is possible.

In order to achieve a pressure compensation at both sides of the roller bearings 19 and 20, so that the suction of lubricating oil or grease can be prevented, bypass openings 48 are arranged in the pipe pieces 10 and 11 in the region outside of the region between the roller bearings 19 and 20.

Figure 9:
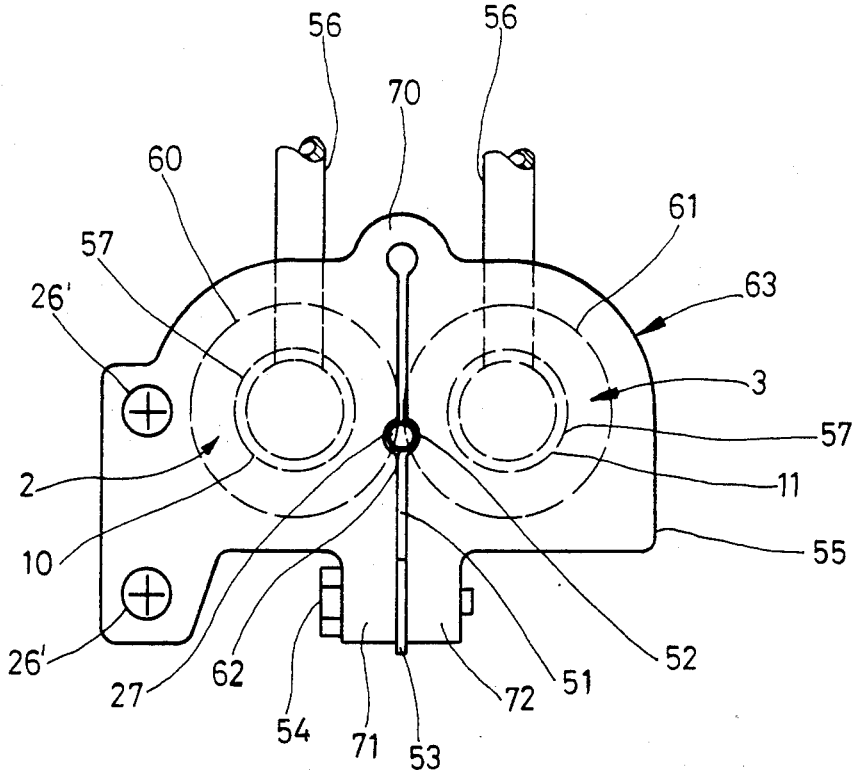
FIG. 9 is a view of a common bearing housing and holders with receptacles for the axles of the rollers which are adjustable with respect to one another, constructed in accordance with a further embodiment of the invention.

In FIG. 9 a holder 63 for the axles of the rollers 2 and 3 is shown, which is inserted similarly to the one in the embodiment of FIG. 8, that means with an arrangement wherein the bearing housing 1 extends essentially only over the axial length of the shells of the rollers 2 and 3 and in which the axles are held at the bearing housing 1 at the front sides by the there arranged covers 63. Embodiments are also contemplated with use of a cover 63 at one side and a direct holding means of shell shaped receptacles 14, 15 at the bearing housing at the other side.

The cover 63 possesses two receptacles 57, for example, in the form of blind holes, in which the axles of the rollers 2 and 3 are inserted, which axles are preferably formed as the pipe pieces 10 and 11. The holder 3 formed as a plate is provided between the receptacles 57 with one side provided with an outwardly open slot 51. The open side oppositely disposed is left as a web 70. Through elastic deformation of the web 70 the distance between the two receptacles 57 with respect to one another can be relatively changed and adjusted, whereby the size of the wedge slot 4 between the rollers 60 and 61 is adjusted. The portion of holder 63 disposed oppositely from the web 70 is provided with two parallel flanges 71 and 72 extending parallel to the slot 51, which by means of the adjusting screw 54 are connected to one another. In the region of the adjusting screw 54 there are one or several spacing disks 53 installed, through which the width of the slot 51 can be varied. Because the sections of the plate formed holder 63 including the two receptacles 57 are and should remain relatively moveable with respect to one another, the holder 63 is only fastened at one side with fastening screws 26' at the bearing housing 1, that means only in the region of one of the receptacles 57.

The holder 63 is provided with suction connections 56 to the receptacles 57, which are connected by means of cross bores or the like with the pipe pieces 10 and 11 serving as axles.

The holder 63 simultaneously serves as receptacle for the thread withdrawal channel 27, which extends in the direction of the wedge slot 4 from a beginning at a side facing the rollers 2 and 3. The holder 63 is provided with an approximately cylindrical opening 52 in the region of the slot 51, in which the thread withdrawal tube 27 is inserted and clamped. The yarn withdrawal tube is surrounded in this region with a rubber elastic shell 62.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open end friction spinning comprising:

two friction rollers arranged adjacent to one another to form a yarn forming wedge slot therebetween, said rollers exhibiting respective roller shells;

roller bearing means rotatably supporting the friction rollers adjacent their respective ends, said shells being arranged and supported at the roller bearing means; and a belt drive means engageable directly at the outer surface of the shells for rotatably driving same during spinning operations.

2. Apparatus according to claim 1, wherein the belt drive means runs respectively in the region of one of the roller bearing means along the coating surface of the roller shells.

3. Apparatus according to claim 1, wherein the belt drive means includes a tangential belt engaging on the surfaces of both roller shells.

4. Apparatus according to claim 1, wherein the roller shells each exhibit a cylindrical pipe formed shape.

5. Apparatus according to claim 2, wherein the roller shells are borne on axles which extend beyond both facing ends of the shells and are held at a common bearing housing.

6. Apparatus according to claim 5, wherein the common bearing housing essentially extends over the axial length of the roller shells, and wherein cover formed holders are arranged on the facing side ends of the common bearing housing, said holders being provided with receptacles for the axles.

7. Apparatus according to claim 6, wherein the axles are clamped in one shell shaped openings of the bearing housing and of the holders.

8. Apparatus according to claim 6, wherein the common bearing housing and the holders are provided with shell-shaped insert means for acceptance of the axles, said insert means being disposed to be adjustable in the direction of the common plane of the axles at the common bearing housing.

9. Apparatus according to claim 6, wherein the recesses of the holders are adjustable in their distance with respect to one another in the direction of the common plane of the axles.

10. Apparatus according to claim 9, wherein the holders are respectively formed out of a plate which is divided between the accomodating axle accomodating recesses by means of a one sided slot facing toward the outside, said slot being bounded by a web interconnecting two sections which are adjustably movable with respect to one another.

11. Apparatus according to claim 10, wherein the two sections of the holder, at the side opposite the web, are connected with one another through at least one adjusting screw.

12. Apparatus according to claim 11, wherein at least one spacing disk is installed in the slot in the region of the adjusting screw.

13. Apparatus according to claim 12, wherein a thread withdrawal tube is installed at a cylindrically widened portion of the slot of one of the holders in the region of the axial extension of the yarn forming wedge slot.

14. Apparatus according to claim 13, wherein the thread withdrawal tube is surrounded with a shell formed out of rubber elastic material in the region of the cylindrically widened portion of the slot.

15. Apparatus according to claim 5, wherein the axle of at least one of the rollers has a roller shell which is perforated in the region between the roller bearings and is hollow-formed and connected to a suction connection and wherein the axle exhibits a slot formed opening facing toward the yarn forming wedge slot.

16. Apparatus according to claim 15, wherein one end of the hollow axle is closed with a closure and the other end is provided with the suction connection.

17. Apparatus according to claim 15, wherein both ends of the hollow axle are closed with closures and wherein a suction connection is provided which is connected by means of a cross bore at the hollow axle in the region of one of the shell-shaped recesses of the bearing housing.

18. Apparatus according to claim 15, wherein both ends of the hollow axle are provided with closures and wherein the holder is provided in the region of a recess with a suction connection which is connected via a cross bore to the axle.

19. Apparatus according to claim 15, wherein the hollow axle is formed out of a pipe piece which is provided with at least one slit at the wall facing the wedge slot.

20. Apparatus according to claim 19, wherein the pipe piece in the region of its at least one slit is provided with an air guide widening opening near to the inner surface of the shell.

21. Apparatus according to claim 19, wherein a filling piece is disposed on the pipe piece adjacent the inside surface of the shell and is provided with a slit at the side facing the wedge slot 4.

22. Apparatus according to claim 15, wherein the hollow axle of at least one of the rollers extends beyond the end of the shell and wherein an outwardly extended bearing inner ring of the roller bearing means holds the hollow axle extension, said bearing inner ring being held in one of the bearing housing holders and arranged in the bearing housing.

23. Apparatus according to claim 22, wherein in both bearing inner rings, inserts are arranged which extend to the inside of the shells and open to the wedge slot and are inserted in a suction insert.

24. Apparatus according to claim 5, wherein the axles are held under the interposition of an insert made out of oscillation damping elastic material in the receptacles of one of the bearing housing and the holders.

25. Apparatus according to claim 5, wherein the bearing housing is provided with a recess for the tangential belt.

26. Apparatus according to claim 19, wherein a bypass opening is disposed in the pipe piece outside of the region between the roller bearings.

* * * * *

UNITED STATES PATENT AND TRADEMARK OFFICE

CERTIFICATE OF CORRECTION

PATENT NO. : 4,514,975

DATED : May 7, 1985

INVENTOR(S) : Fritz Stahlecker

It is certified that error appears in the above-identified patent and that said Letters Patent is hereby corrected as shown below:

In [73] change "DEX" to --Federal Republic of Germany--.

Signed and Sealed this

*Twenty-first* Day of *January 1986*

[SEAL]

*Attest:*

DONALD J. QUIGG

*Attesting Officer*

*Commissioner of Patents and Trademarks*